US007185846B1

(12) United States Patent
Bittle et al.

(10) Patent No.: US 7,185,846 B1
(45) Date of Patent: Mar. 6, 2007

(54) ASYMMETRICAL CONTROL SURFACE SYSTEM FOR TUBE-LAUNCHED AIR VEHICLES

(75) Inventors: David A. Bittle, Somerville, AL (US); Gary T. Jimmerson, Athens, AL (US); Julian L. Cothran, Arab, AL (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 11/370,390

(22) Filed: Mar. 6, 2006

(51) Int. Cl.
*F42B 10/00* (2006.01)

(52) U.S. Cl. ..... 244/3.28; 244/3.27; 244/46; 102/490

(58) Field of Classification Search ..... 244/46, 244/3.24, 3.26, 3.27, 3.29, 3.28; 102/490
See application file for complete search history.

(56) References Cited

U.S. PATENT DOCUMENTS 3,063,375 A * 11/1962 Hawley et al. ..... 244/3.27
3,415,467 A * 12/1968 Barringer ..... 244/3.29
3,643,599 A * 2/1972 Hubich ..... 102/388
4,158,447 A * 6/1979 Humphries et al. ..... 244/3.27
4,336,914 A * 6/1982 Thomson ..... 244/46
4,913,675 A * 4/1990 Wilcox ..... 446/36
5,078,339 A * 1/1992 Lapidot ..... 244/49
5,085,380 A * 2/1992 Barton ..... 244/3.21
5,108,051 A * 4/1992 Montet et al. ..... 244/3.28
6,056,237 A * 5/2000 Woodland ..... 244/3.15
6,073,880 A * 6/2000 Voigt et al. ..... 244/3.28
6,427,599 B1 * 8/2002 Posson et al. ..... 102/336
6,588,700 B2 * 7/2003 Moore et al. ..... 244/3.28
6,672,537 B1 * 1/2004 Deckard et al. ..... 244/3.29
6,923,404 B1 * 8/2005 Liu et al. ..... 244/46
6,966,526 B2 * 11/2005 Lawless ..... 244/201
7,083,140 B1 * 8/2006 Dooley ..... 244/3.27
2005/0236514 A1 * 10/2005 Lawless ..... 244/3.27

* cited by examiner

*Primary Examiner*—Teri Pham Luu
*Assistant Examiner*—Joseph W. Sanderson
(74) *Attorney, Agent, or Firm*—Hay Kyung Chang

(57) ABSTRACT

Asymmetrical Control Surface System for Tube-Launched Air Vehicles places one control surface, such as a wing or a horizontal tail, above horizontal midplane axis of an air vehicle, such as a tube-launched missile, and the opposing control surface below the midplane axis. Such asymmetrical arrangement of the control surfaces increases the lift and maneuverability of the air vehicle during flight. For stowage inside the tube prior to launch, each control surface slides into its corresponding slot in the body of the vehicle, making the entire control system compact.

7 Claims, 4 Drawing Sheets

ASYMMETRICAL CONTROL SURFACE SYSTEM FOR TUBE-LAUNCHED AIR VEHICLES

DEDICATORY CLAUSE

The invention described herein may be manufactured, used and licensed by or for the Government for U.S. governmental purposes; provisions of 15 U.S.C. Section 3710c apply.

BACKGROUND OF THE INVENTION

In the field of guided missile and artillery rocket ballistics and aerodynamics, typical air vehicles employ a number of different concepts for propulsion and lift. Some of the lift and guidance schemes utilize lateral thrusters, deployed wing and tail surfaces and non-circular cross sections. All of the concepts and schemes, however, share one thing in common; that being symmetry between the lift and control surfaces on the left side and the right side of the air vehicle. The popularity of the symmetric lift and control surfaces is due to the fact that this arrangement makes the vehicle generally easier to stabilize and steer and also simplifies the guidance and control of the vehicle during flight. Further, symmetric control surfaces are much more intuitively obvious to the vehicle designers than are non-symmetric lifting and control surfaces.

However, for a tube-launched air vehicle, the size constraints of the launch tube greatly limit the size and shape of the control surfaces that can be accommodated in the stowed position. These size and shape limitations reduce the capability of the air vehicle as a weapon system since symmetrical control surfaces beyond a certain shape and size will not fit within the constraints of the vehicle packaging inside the launch tube.

SUMMARY OF THE INVENTION

Asymmetrical Control Surface System for Tube-Launched Air Vehicles places one control surface, such as a wing or a horizontal tail, above horizontal midplane axis 201 of air vehicle 100 and the opposing control surface below the midplane axis. FIG. 1 shows the wings and tails in their fully deployed positions after being launched from the launch tube. For stowage inside the tube, each control surface slides into its corresponding slot in the body of the vehicle: second horizontal tail 109 into slot 105 and first wing 101 into slot 103 as illustrated in FIG. 1. Second wing 107 and first horizontal tail 102 also slide into their respective slots (not shown).

DESCRIPTION OF THE PREFERRED EMBODIMENT

Figure 1:
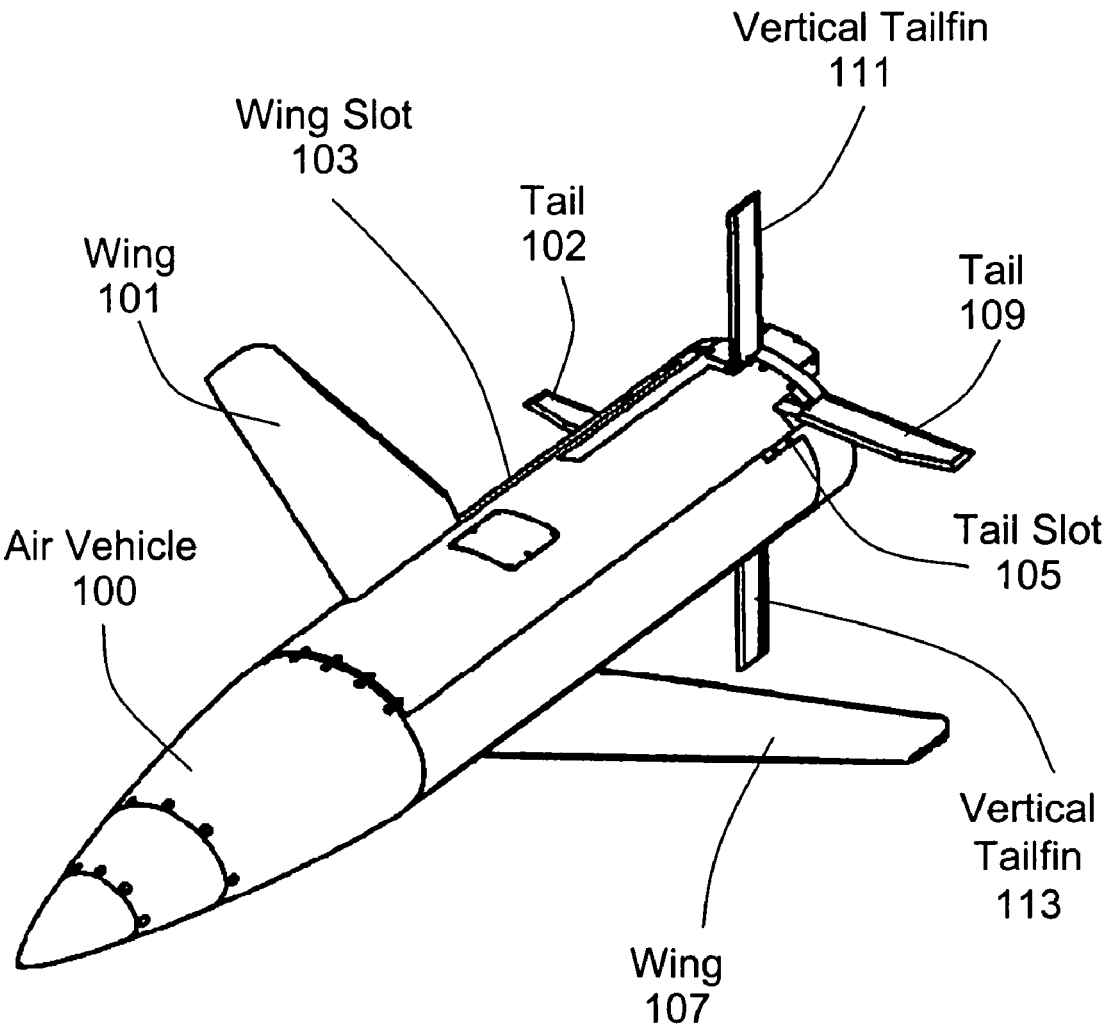
FIG. 1 shows the various control surfaces in their fully deployed positions on the air vehicle.
Figure 2:
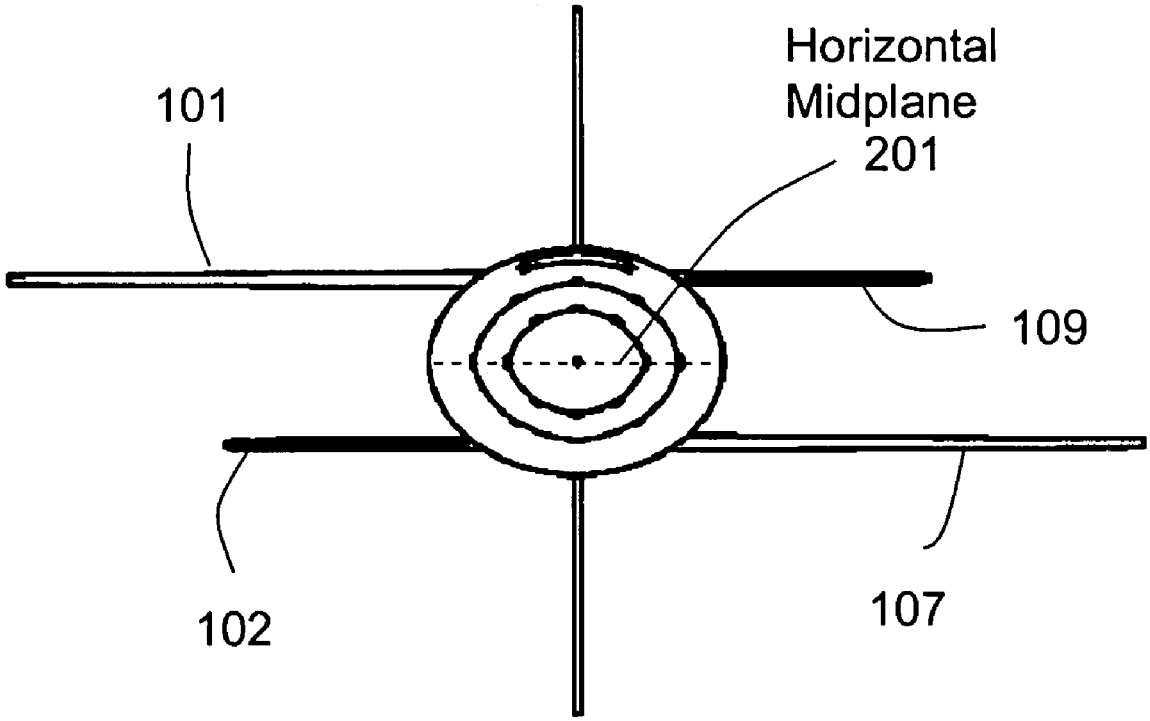
FIG. 2 is a frontal view of the deployed control surfaces, clearly illustrating the placement of wings and horizontal tails above and below midplane axis 201.
Figure 3:
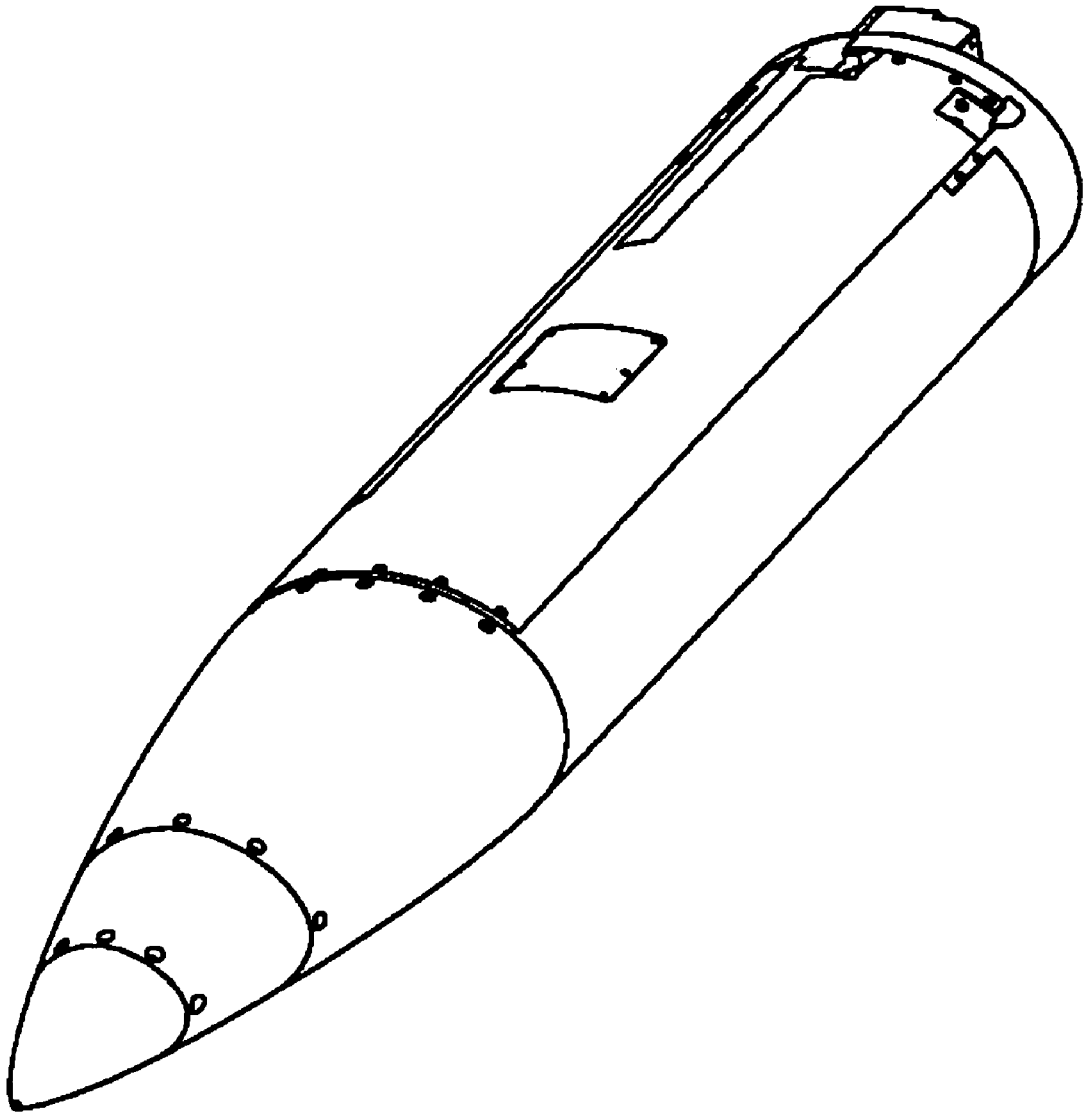
FIG. 3 shows the air vehicle with control surfaces in stowed position.

As FIGS. 1 and 2 show, the placement of the wings and horizontal tails on air vehicle 100 is asymmetrical. First wing 101 is positioned above midplane axis 201 and second wing 107 is positioned below the axis while first horizontal tail 102 is positioned below the axis and second horizontal tail 109 is positioned above the axis.

Such asymmetrical arrangement of the wings improves the capability, in terms of aerodynamic performance, of vehicles that cannot symmetrically package optimized control surfaces inside the launch tubes. The same rationale applies to asymmetrical arrangement of the horizontal tails.

Packaging the control surfaces asymmetrically, in essence, doubles the stowed storage space available for each of them since two wings, for example, do not need to be accommodated in the same slot such as slot 103. With additional stowed storage space available, the air vehicle designer can optimize the size (make them bigger than they could be if arranged symmetrically) and shape of the control surface for greater performance.

Further, the alternating placement of the wing and tail above and below the midplane axis on the same side (example: right side) of the air vehicle increases the effectiveness of the tails by assuring that the tails move through air that has not been disturbed by the wings.

Preferably the first wing and second tail are placed between approximately ⅔ and ¾ of the distance from the midplane axis to the top of the vehicle body and the second wing and the first tail are placed between approximately ⅔ and ¾ of the distance from the midplane axis to the bottom of the vehicle body as illustrated in FIGS. 1 and 2. But it is not necessary that the size and shape of the wing surfaces be the same or that the size and shape of the horizontal tails be the same. Each of the wings and the tails can be individually optimized to maximize the performance of the air vehicle.

After the air vehicle is launched from the tube, each of the control surfaces, whether it be a wing or a horizontal tail, is deployed from its respective slot by an actuator. All of the actuators function in a like manner.

Figure 4:
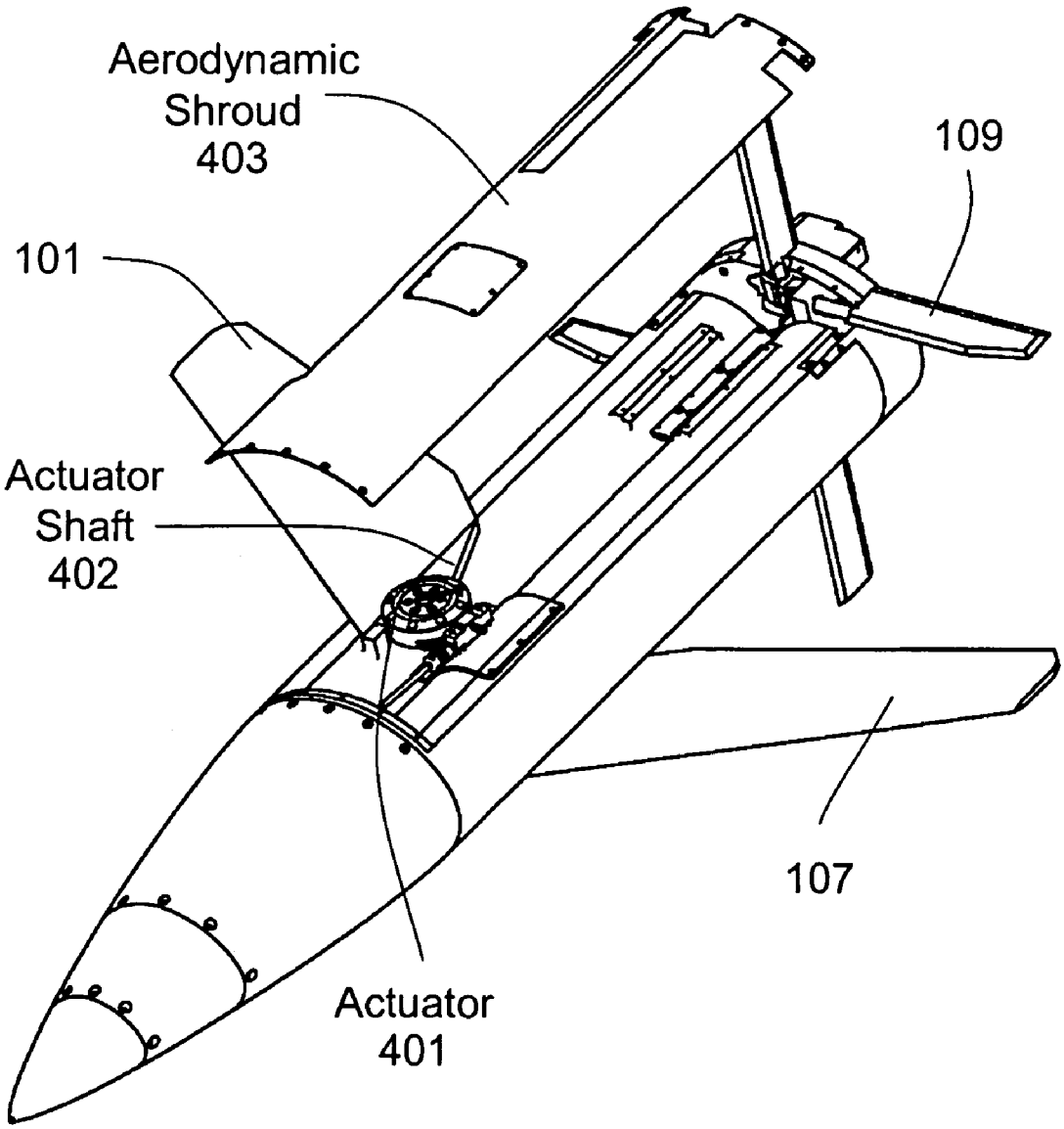
FIG. 4 is an exploded view of a preferred embodiment of the Asymmetrical Control Surface System for Tube-Launched Air Vehicles.

FIG. 4 shows a representative actuator 401 (associated with first wing 101). In response to the vehicle's control computer (not shown but most likely located in the nose section of the air vehicle), the actuator deploys, via actuator shaft 402, the first wing to a pre-determined deployment angle and locks it in place, the deployment angle depending on multiple factors such as the Mach number of the vehicle, general shape of the vehicle and desired maneuverability.

Aerodynamic shroud 403 may be used to cover the actuator mechanism for first wing 101 and second horizontal tail 109 to provide protection from external elements and to minimize aerodynamic drag of the vehicle. Another shroud would be used on the underside of the vehicle similarly to protect actuators for second wing 107 and first horizontal tail 102 and decrease aerodynamic drag.

Suitable materials for the control surfaces, as well as the air vehicle itself, would depend on the particular air vehicle and its purposes, but may include high-strength and light-weight material such as an aluminum alloy or composite.

The Asymmetrical Control Surface System for Tube-Launched Air Vehicles allows the maximum range and maneuverability of the air vehicles to be increased substantially over using symmetrically arranged control surfaces. Due to the larger size of the wings and the tails made possible by the asymmetric arrangement, the vehicle generates much more lift resulting in greater range and is capable of greater maneuverability, respectively. The increase in aerodynamic drag due to the larger size of the control surfaces is minimal. The net result is a significant improvement in the performance of the air vehicle.

We claim:

1. Asymmetrical control surface system for an air vehicle, the air vehicle having a horizontal midplane axis, a controlling computer, vertical tails and further being stowable in and launchable from a tube, said asymmetrical control surface system comprising: a plurality of stowable wings, said wings being deployable upon launch of the air vehicle from the tube, at least one of said wings being movably attached to the vehicle above said midplane axis and at least one of said wings being movably attached to the vehicle below said midplane axis; a plurality of horizontal tails, at least one of said horizontal tails being movably attached to the vehicle above said midplane axis and at least one of said horizontal tails being movably attached to the vehicle below said midplane axis; and a means to deploy said wings and horizontal tails in response to the controlling computer.

2. Asymmetrical control surface system for an air vehicle as set forth in claim 1, wherein said system further comprises a plurality of slots positioned within the vehicle, said slots being of sufficient dimensions to stow said wings and horizontal tails, respectively, therein so as to enable the air vehicle, said wings and horizontal tails to be stowed within the tube prior to launch.

3. Asymmetrical control surface system as set forth in claim 2, wherein said deploying means comprises a plurality of actuators, each of said wings and horizontal tails being coupled to one of said actuators, said actuators responding to the controlling computer to deploy its respective wing or tail.

4. Asymmetrical control surface system as set forth in claim 3, wherein said plurality of wings comprises: a first wing positioned at approximately ⅔ way of the distance from said midplane axis to the top of the vehicle body; and a second wing positioned at approximately ⅔ way of the distance from said midplane axis to the bottom of the vehicle body.

5. Asymmetrical control surface system as set forth in claim 4, wherein said plurality of horizontal tails comprises: a first horizontal tail positioned approximately ⅔ way below said midplane axis and a second horizontal tail positioned approximately ⅔ way above said midplane axis, such that said first wing and said first horizontal tail are positioned on opposite sides of the air vehicle.

6. Asymmetrical control surface system as set forth in claim 5, wherein each of said actuators is coupled to its respective wing or tail via an actuator shaft, said shaft motivating said wing or tail to deploy to a pre-determined angle.

7. Asymmetrical control surface system as set forth in claim 6, wherein said control system further comprises: a first and a second aerodynamic shrouds, said shrouds being placed on opposite sides of the vehicle, said shrouds protecting said deploying means from exterior elements.

* * * * *